United States Patent [19]

Mayer

[11] 4,290,491

[45] Sep. 22, 1981

[54] ROCK DRILL POSITIONING MECHANISM

[75] Inventor: James R. Mayer, Englewood, Colo.

[73] Assignee: Cooper Industries, Inc., Houston, Tex.

[21] Appl. No.: 938,613

[22] Filed: Aug. 31, 1978

[51] Int. Cl.[3] ..... E21C 5/00; E21C 9/00

[52] U.S. Cl. ..... 173/43

[58] Field of Search ..... 173/38, 42, 43, 44

[56] References Cited

U.S. PATENT DOCUMENTS

| | | | |
|---|---|---|---|
| 2,491,273 | 12/1949 | Lehner | 173/44 X |
| 3,338,316 | 8/1967 | Thompson | 173/43 |
| 3,381,762 | 5/1968 | Lewis et al. | 173/43 |
| 3,563,321 | 2/1971 | Barendsen et al. | 173/43 |
| 3,782,484 | 1/1974 | Martin | 173/43 |

*Primary Examiner*—Wm. Carter Reynolds
*Attorney, Agent, or Firm*—Michael E. Martin

[57] ABSTRACT

A rotary actuator is pivotally mounted on the end of a drill boom and supports a rock drill feed bar for rotation about a longitudinal axis of the actuator. The rotary actuator includes a piston with a piston rod portion having external and internal helical splines engaged with cooperating splines on the actuator housing and a rotating shaft, respectively. The shaft is connected to the feed bar and is operable to rotate the feed bar in response to axial movement of the piston. The axis of rotation of the shaft may be coincident with the longitudinal axis of the drill boom. The drill boom is mounted on a rotary actuator for swinging movement about a vertical axis.

17 Claims, 8 Drawing Figures

ROCK DRILL POSITIONING MECHANISM

BACKGROUND OF THE INVENTION

Portable rock drill apparatus adapted for underground mining and tunnelling operations are generally characterized by a movable boom for supporting at the distal end thereof an elongated drill guide or feed bar upon which a rock drill is slidably mounted. The feed bar is normally connected to the boom by way of a positioner mechanism to provide for positioning the feed bar in a wide range of positions so that a large number of blast holes may be drilled in a work surface in a particular pattern. Moreover, it is usually desired to be able to drill as many holes as possible in the workface which are parallel or nearly parallel to each other.

A number of inventions have been developed in an effort to provide a positioning mechanism which provides unrestricted movement of the feed bar with respect to the boom in order to provide the largest possible workface area in which parallel or nearly parallel holes can be drilled. U.S. Pat. No. 3,563,321, for example, discloses a positioning mechanism wherein a piston has helical splines disposed on one piston rod portion and straight splines disposed on an opposite piston rod portion. The piston is housed in a cylinder and is operably connected to a drill feed bar for rotating the same in response to axial movement of the piston.

The present invention provides improvements in rock drill positioning mechanisms including the type disclosed in U.S. Pat. No. 3,563,321 by providing a positioner mechanism which is more compact, robust, and provides for a greater drill hole workface area for parallel or nearly parallel holes than prior art positioning mechanisms.

SUMMARY OF THE INVENTION

The present invention provides an improved rock drill boom and positioning mechanism combination in which a high degree of freedom of movement of the drill feed bar is obtained for drilling a large workface area.

The present invention also provides a positioning mechanism adapted to be mounted on the distal end of a drill boom or the like and which is operable to position a rock drill feed bar in an extensive range of positions to provide larger drill hole workface patterns for a given position of a drill rig than prior art positioners.

The present invention further provides a rock drill positioning mechanism which is operable to position a drill feed bar by rotating said feed bar about an axis whereby a large number of parallel holes may be drilled.

The positioning mechanism of the present invention provides a greater range of angular positioning of a feed bar with compact and rugged actuating means comprising a reciprocable piston having external and internal helical splines cooperable with a cylinder housing and a rotatable shaft fitted with respective cooperating splines. Thanks to an improved bearing support arrangement for the piston, the rotating shaft, and a feed bar support bracket drivenly connected to the shaft the rotary positioning mechanism of the present invention is particularly suited for withstanding the substantial forces exerted thereon by the drill feed bar.

The feed bar positioning mechanism of the present invention represents a further improvement in the art by providing an arrangement whereby the axis of rotation of the rotary actuator may be aligned with the longitudinal axis of the drill boom so that the area of the workface which cannot be drilled with parallel holes is minimized.

The above noted, as well as other superior features of the present invention, will be appreciated by those skilled in the art upon reading the description of the preferred embodiment together with the drawings.

DESCRIPTION OF THE PREFERRED EMBODIMENT

Figure 2:
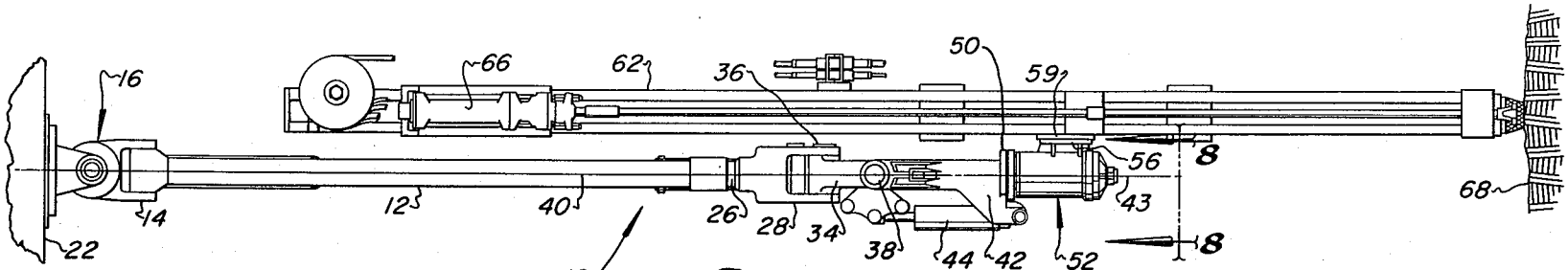
FIG. 2 is a plan view of the boom and feed bar assembly shown in FIG. 1.
Figure 1:
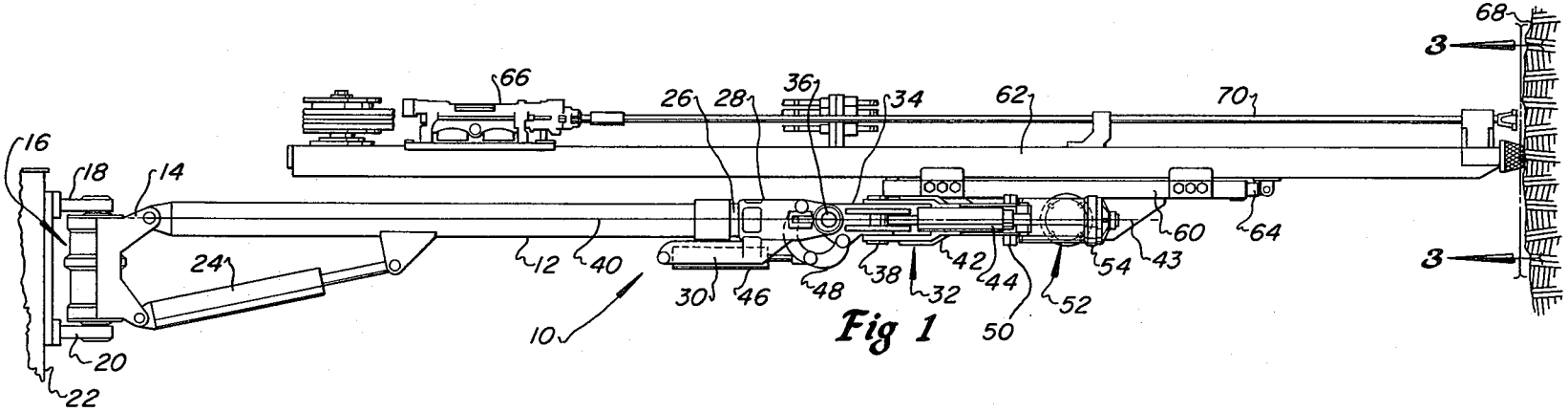
FIG. 1 is a longitudinal side elevation of a rock drill boom and feed bar in combination with the positioning mechanism of the present invention.
Figure 3:
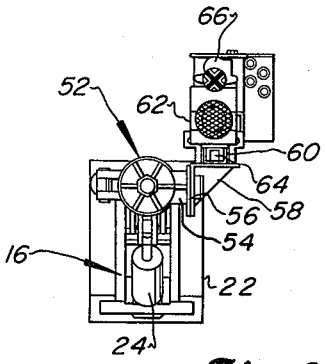
FIG. 3 is an end elevation view taken from the line 3—3 of FIG. 1.

Referring to FIGS. 1, 2 and 3 of the drawings there is shown a drill boom and feed apparatus generally designated by the numeral 10. The apparatus 10 includes an elongated tubular boom member 12 which is pivotally mounted at one end thereof to a clevis 14 for movement about a substantially horizontal axis. The clevis 14 comprises part of an actuator mechanism, generally designated by the numeral 16, which is adapted to swing the boom 12 about a substantially vertical pivot formed in part by spaced apart brackets 18 and 20. The brackets 18 and 20 may be part of a further supporting structure 22 such as the frame of a movable drill carriage or the like. The boom 12 includes an extensible hydraulic cylinder actuator 24 connected as shown in FIG. 1, for pivoting the boom about a substantially horizontal pivot axis formed by the clevis 14.

The distal end of the boom member 12 supports a secondary boom member 26 which may be fixed to the member 12 or telescopically disposed within the member 12. The boom member 26 supports a clevis 28 which has a depending portion 30 as shown in FIG. 1. A feed bar positioning mechanism, generally designated by the numeral 32, includes a connecting member 34 which is adapted to be mounted for pivotal movement about a horizontal pivot axis formed by the clevis 28 and a suitable pivot pin 36 as shown in FIG. 1. The connecting member 34 is formed to provide a second pivot 38 perpendicular to the axis of the pin 36. The axes of the pivots 36 and 38 intersect the coincident longitudinal central axes of the boom members 12 and 26 which are regarded as one and are designated by the numeral 40. The axis 40 intersects the pivot axis formed by the clevis 14 and the pivot axis of the swing actuator 16 also. The connecting member 34 is positioned with respect to the clevis 28 by a hydraulic cylinder actuator 46, FIG. 1 connected at one end thereof to the depending portion 30 and at the opposite end to linkage 48 connected to the connecting member as well as the clevis 28.

Figure 8:
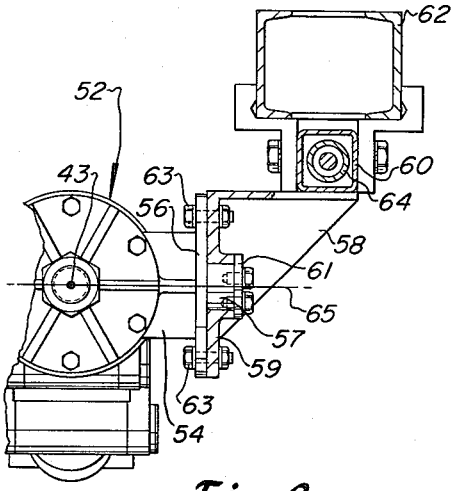

The positioning mechanism 32 also includes a mounting arm 42 which has a clevis providing for pivotally mounting the arm on the connecting member 34 for movement about the pivot 38. A hydraulic cylinder actuator 44 interconnected between the arm 42 and the member 34 provides for moving the arm about the pivot 38. The arm 42 is also characterized by a transverse flange 50 formed on the end opposite the pivot 38 and on which is mounted a rotary actuator, generally designated by the numeral 52. The actuator 52 includes a generally cylindrical outer housing 54 having a flange 56 to which is fastened a bracket 58 as shown in FIGS. 3 and 8. The bracket 58 supports a slide 60 on which is mounted an elongated drill feed bar 62. The feed bar 62 is adapted to be supported on and extendable relative to the slide 60 by conventional means such as a hydraulic cylinder actuator 64. The feed bar 62 supports a percussion rock drill 66 which is advanced and retracted with respect to a work surface 68 by suitable mechanism, not shown. The drill 66 is operable to form drill holes by delivery of percussive blows through a drill stem 70 in a known way.

Figure 4:
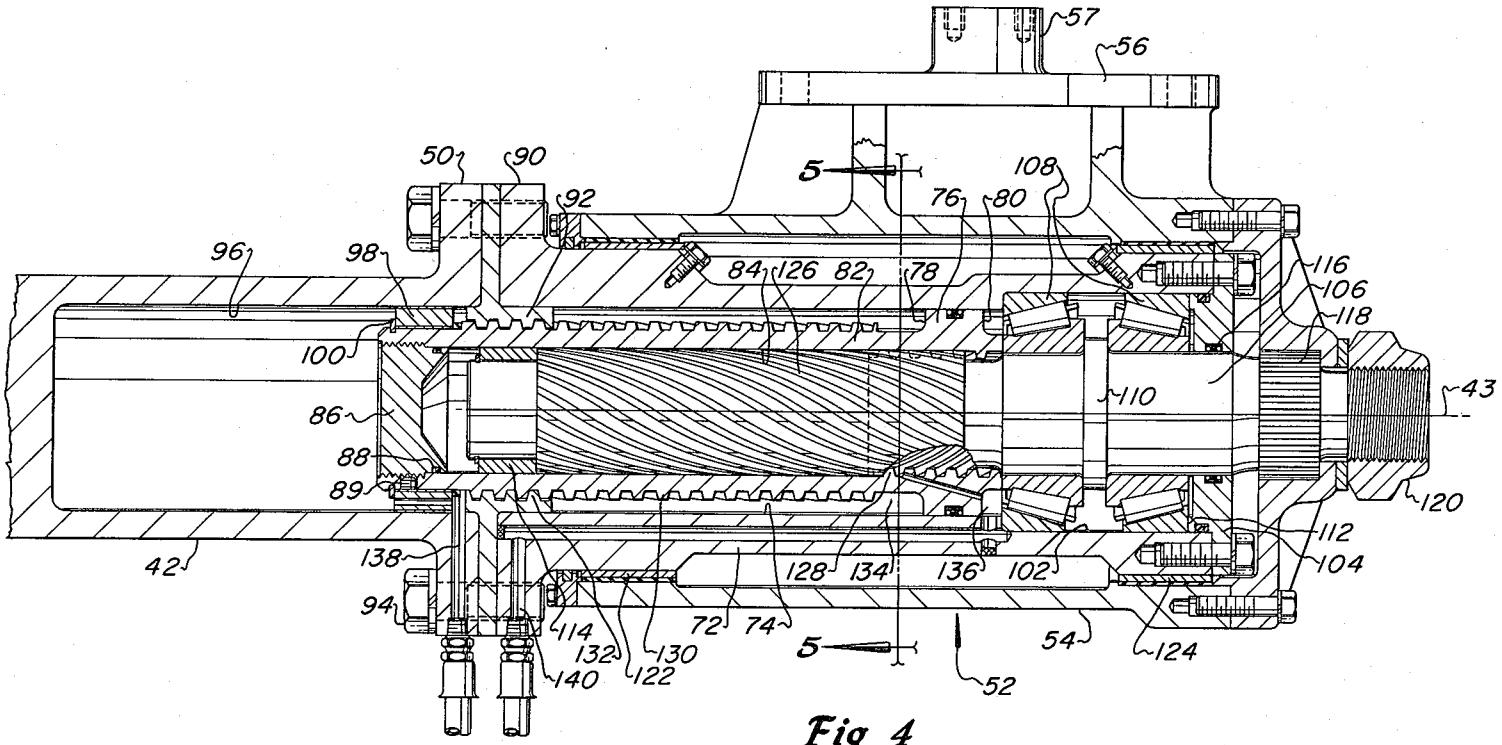
FIG. 4 is a longitudinal central section view of the rotary actuator of the feed bar positioning mechanism of the present invention.

The rotary actuator 52 is operable to rotatably position the feed bar 62 about an axis 43, FIG. 4, which may be coincident with the longitudinal axis 40 of the drill boom 12 as may be appreciated from viewing FIGS. 1, 2 and 3. The rotary actuator 52 is particularly adapted for supporting the weight of the feed bar and for withstanding the lateral forces imposed thereon by the feed bar and the action of advancing the drill 66 toward the work surface 68. Moreover, the rotary actuator is particularly compact considering that the included angle within which the feed bar may be positioned may be at least 270° measured in a plane perpendicular to the axis of rotation.

Referring to FIG. 4 the rotary actuator 52 is characterized by an inner housing 72 having a first longitudinal bore 74 in which is slidably disposed a piston 76. The piston 76, which includes opposed piston faces 78 and 80, is also characterized by an integral rod portion 82 extending axially from the face 78 only. A longitudinal bore 84 extends entirely through the piston including the rod portion 82. A removable cap 86 is threadedly retained in the bore 84 at the end of the piston rod portion 82 opposite the piston face 78. An O-ring 88 forms a fluid-tight seal at the cap 86. The cap 86 is locked in assembly with the piston rod 82 by a set screw 89.

The inner housing 72 includes a transverse flange 90 which provides for bolting the housing to the flange 50 on the mounting arm 42. A flanged collar 92 is disposed between the facing surfaces of the flanges 90 and 50. Suitable fasteners 94 provide for holding the inner housing 72 and the collar 92 in assembly with the arm 42. As shown in FIG. 4 the arm 42 is provided with a longitudinal bearing bore 96 to accommodate axial displacement of the piston rod 82. A bearing comprising a bushing 98 made of suitable bearing material is retained on the rod 82 by a retaining ring 100. The bearing 98 permits rotation and axial translation of the rod 82 while supporting the end thereof in the bore 96.

The end of the inner housing 72 opposite the flange 90 is provided with a second longitudinal bore 102 which is closed by a removable cover member 104. A rotatable shaft 106 is disposed within the inner housing and is mounted on tapered roller bearings 108 mounted back to back in the second bore 102. A shoulder 110 on the shaft 106 separates the inner races of the roller bearings 108. Axial excursion of the shaft is prevented by shims 112 which are interposed between the cover 104 and the outer race of one of the bearings 108 as shown in FIG. 4. The shaft 106 extends into the bore 84 in the piston 76 and the end of the shaft disposed in the piston rod bore is mounted in a bearing formed by a cylindrical bushing 114 which is closely fitted in the bore 84.

The opposite end of the shaft 106 extends through a suitable bore in the cover member 104. A fluid seal 116 is mounted in the cover member 104 and engages the shaft 106. The distal end of the shaft 106 projecting from the cover member 104 is nonrotatably engaged with the outer housing 54 by suitable interfitting straight splines 118. A nut 120 is threadedly engaged with the shaft 106 and retains the outer housing 54 thereon. The outer housing 54 is disposed around the inner housing 72 and includes sleeve bearings 122 and 124 which are engageable with suitable cylindrical bearing surfacs formed on the exterior of inner housing.

Figure 5:
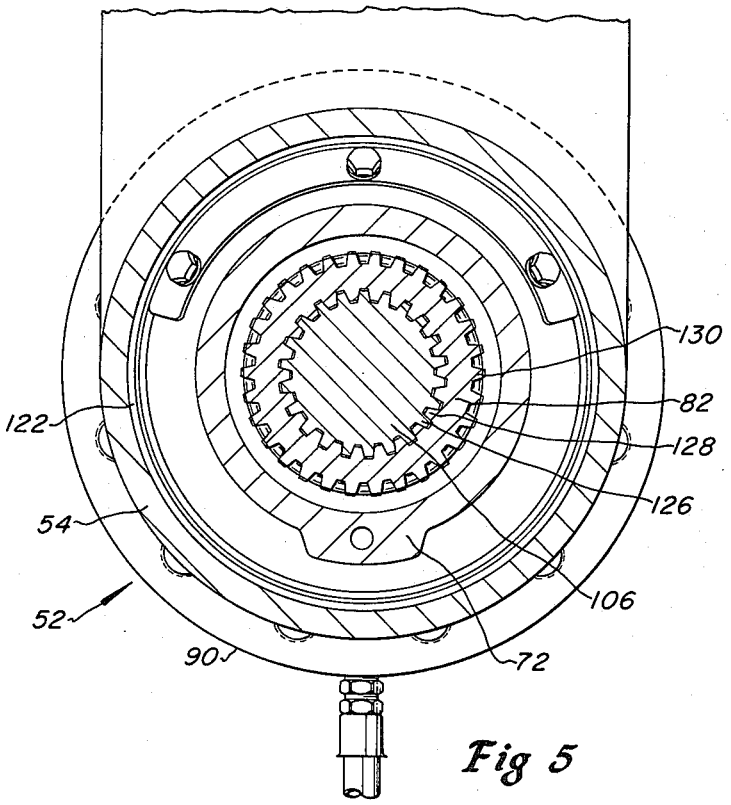
FIG. 5 is a section view taken along the line 5—5 of FIG. 4.

The outer housing 54 is rotated by the shaft 106 in response to axial displacement of the piston 76 under the urging of pressure fluid acting on the face 78 or the face 80. Referring to FIGS. 4 and 5 the shaft 106 is further characterized by elongated helical splines 126 formed on the exterior surface thereof and engaged with cooperating helical splines 128 formed on the interior wall surface of the piston rod 82. The splines 128 extend over a shorter portion of the piston rod than do the shaft splines 126 to provide for a suitable bearing surface in the bore of the piston rod 82 to accommodate the bushing 114.

The exterior surface of the piston rod 82 is also provided with helical splines 130 extending over a major portion of the piston rod and being of the opposite hand with respect to the splines 126. The splines 130 are engaged with cooperable internal splines 132 formed on the collar 92. The splines 126 and 128 are preferably of the opposite hand with respect to the splines 130 and 132 although the two sets of splines could be of the same hand with different helix angles or one set of splines could be straight and the other set helical. The helix angles of both sets of splines are preferably in the range of 25° to 30°.

Pressure fluid such as hydraulic oil may be introduced into chambers 134 or 136 formed in the inner housing bore 74 by way of suitable passages 138 and 140, respectively. In response to pressure fluid being introduced into the chamber 136, for example, the piston 76 is moved axially to the left, viewing FIG. 4, but due to the interengaged splines 130 and 132 the piston is also forced to rotate about its longitudinal axis. Moreover, as the piston 76 moves axially the interengaged splines 126 and 128 force the shaft 106 to rotate with respect to the piston and since the piston rotates with respect to the inner housing 72 the rotation of the shaft is compounded. Accordingly, a large rotational arc may be obtained for the feed bar 62 with a relatively compact actuator mechanism. Introduction of pressure fluid into the chamber 134 will, of course, reverse the axial and rotational movement of the piston 76 and the rotational movement of the shaft and outer housing 54.

The rotary actuator 52, in addition to providing for a superior positioning mechanism for a rock drill feed bar, is particularly adapted to support the feed bar thanks to the arrangement of the roller bearings 108 and the bushings 98, and 114 which are designed to prevent deflection of the shaft 106 and the piston 76 which could be imposed thereon by the weight of and the forces generated by the feed bar and the drill mounted thereon. Moreover, the reaction forces generated by the feeding of the drill are also transmitted to the tapered roller bearings which are adequately proportioned to accommodate the weight of the feed bar and drill as well as the radial and thrust loads imposed on the shaft due to feeding forces and percussive reaction forces of the drill.

As may be appreciated by the foregoing description the positioning mechanism 32 provides for the drilling of a large workface area wherein parallel or nearly parallel holes may be drilled. The compact rotary actuator 52 which is mounted so that its axis of rotation may be coincident with the longitudinal axis of the boom and which is able to position the feed bar in substantially any angular position within a large arc, depending on the position of the boom with respect to the feed bar, substantially reduces the so-called "blind area" of the drill workface which cannot be drilled with holes which are parallel. Moreover, the arrangement whereby the mounting arm 42 is provided with a flange for mounting the rotary actuator 52 at the outer end of the arm enables the actuator to rotatably position the feed bar in a larger arc without interference with part of the actuator mechanism itself.

Those skilled in the art will also appreciate that the rotary actuator 52 may be adapted to provide for fixing the shaft 106 stationary with respect to the arm 42 and mounting the feed bar on the inner housing which would be rotated in response to axial displacement of the piston 76.

The larger workface area which may be drilled using the drill boom and feed apparatus 10 is also due in part to the swing actuator 16 in combination with the boom 12 and the positioning mechanism 32. The swing actuator 16 eliminates the need for the conventional extensible hydraulic cylinder type actuator, similar to the actuator 24, for swinging the boom about a vertical axis, and which interferes with the feed bar in certain positions thereof. Moreover, the actuator 16 is compact, being disposed entirely between the brackets 18 and 20, and provides for swinging the boom 12 in a circular arc of at least 100°.

Figure 7:
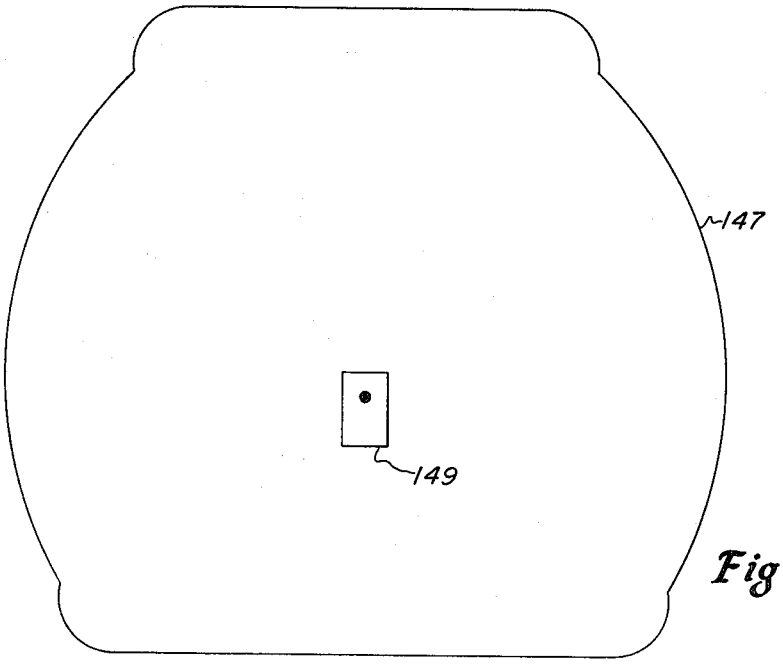
FIG. 7 is a diagram showing the general outline of the planar workface area which may be drilled with parallel holes by the apparatus of the present invention; and, FIG. 8 is a view, partly in section, taken from the line 8—8 of FIG. 2.

FIG. 7 shows a diagram of the general shape of a workface which may be drilled with parallel holes with the apparatus 10. All of the area within the envelope 147 except the area within the small rectangle 149 may be drilled with parallel holes. By way of example the maximum height and width of the envelope 147 may be approximately 10.5 m and 12.5 m, respectively, while the height and width of the "blind" area within rectangle 149 is only 0.8 m and 0.5 m, respectively.

Figure 6:
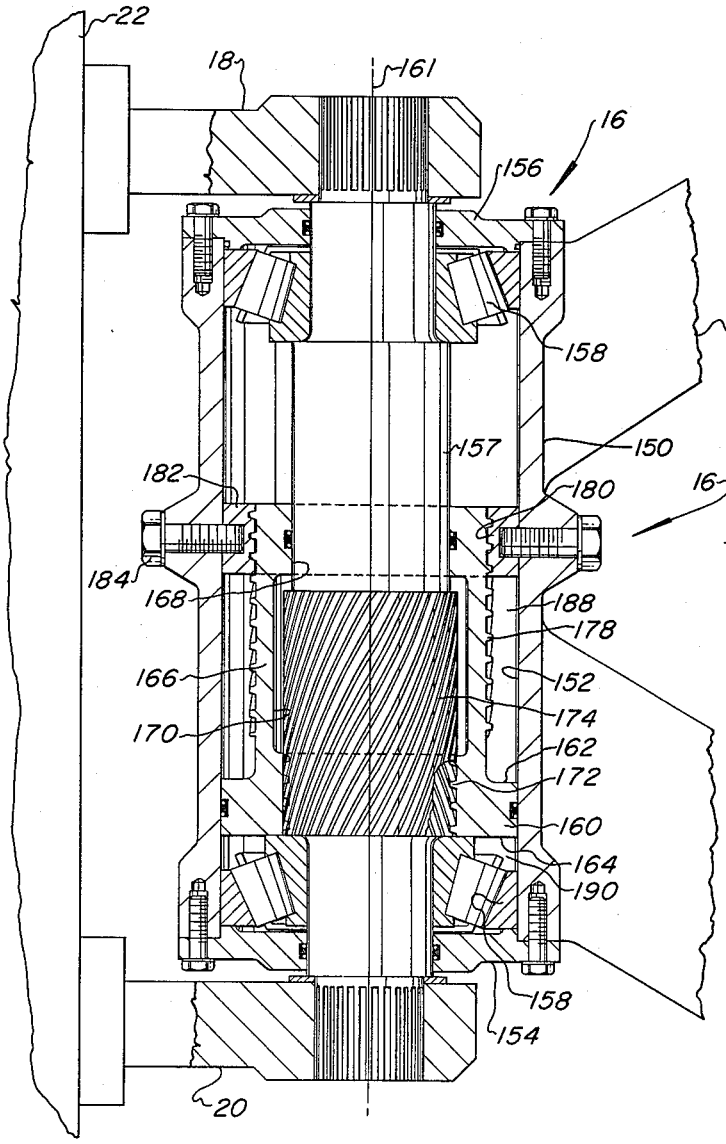
FIG. 6 is a longitudinal section view of the drill boom swing positioning actuator.

Referring to FIG. 6, the actuator 16 includes a housing 150 integrally formed with the clevis 14 and including a longitudinal bore 152 and end covers 154 and 156. The housing 150 is rotatably mounted on a shaft 157 by spaced apart tapered roller bearing assemblies 158. The shaft 157 is nonrotatably mounted in the brackets 18 and 20 by suitable interfitting longitudinal straight splines or the like. The actuator 16 also includes a piston 160 including opposed pressure faces 162 and 164 and a hollow piston rod 166. A bore 168 extends through the piston 160 and includes an intermediate enlarged or radially relieved portion 170. A portion of the bore 168 also includes internal helical splines 172 which are interfitted in cooperable external helical splines 174 extending over a portion of the shaft 157. The piston rod 166 includes external helical splines 178 which are cooperable with complementary helical splines 180 formed on a collar 182 disposed in the housing bore 152 and suitably fixed to the housing 150 by fasteners 184. The splines 172 and 174 preferably have a helix angle of the opposite hand with respect to the splines 178 and 180 in order to provide for a large swing angle of the housing 150 with respect to the brackets 18 and 20.

The operation of the actuator 16 to effect rotation of the housing 150 may be obtained by introducing pressure fluid into chambers 188 or 190 in the housing to act on the respective piston faces 162 and 164. Pressure fluid may be supplied to the chambers 188 and 190 by suitable conduits, not shown. Movement of the piston 160 axially along the shaft will also result in rotation of the piston due to the interfitted splines 172 and 174. Axial and rotational movement of the piston 160 will cause rotation of the housing 150 with respect to the piston due to the interfitted splines 178 and 180. Accordingly, a relatively large angle of swing with respect to the longitudinal axis of the shaft 160 may be obtained by a compact actuator which is part of the pivot for the boom 12. Moreover, the rate of movement of the boom as it is swung by the actuator 16 is substantially constant and easier to control than prior art arrangements using telescoping struts comprising hydraulic cylinder and piston type actuators.

The range of positions in which the feed bar 62 may be oriented is still further increased by the manner in which the feed bar support bracket 58 is fastened to the flange 56. As shown in FIGS. 4 and 8 the flange 56 includes a trunnion 57 for locating a flange 59 on the bracket 58. A retainer plate 61, removably fastened on the end of the trunnion 57, is provided for retaining the bracket 58 on the flange even if bolts 63 are removed. The bolts 63 are preferably arranged in a circular pattern so that the bracket 58 may be fastened to the flange 56 in a plurality of different positions. Accordingly, feed bar 62 may be rotatably positioned about an axis 65 which is perpendicular to and intersects the axis of rotation 43 of the actuator 52. Remote controlled positioning means could be adapted to rotate the bracket 58 with respect to the actuator 52.

With the arrangement shown for positioning the bracket 58 with respect to the actuator 52 the feed bar 62 may be oriented for vertical drilling in either direction as well as for drilling so-called "fan" or "ring" hole patterns.

What is claimed is:

1. A rock drill positioning mechanism for positioning a drill feed bar or the like in combination with an elongated movable boom, said positioning mechanism being characterized by:

a connecting member pivotally mounted on the distal end of said boom;

a mounting arm pivotally connected to said connecting member;

actuator means interconnected between said connecting member and said arm for pivoting said arm with respect to said connecting member; and, a rotary actuator mounted on said arm and adapted to support said feed bar for rotating said feed bar about an axis of rotation which may be substantially coincident with the longitudinal axis of said boom depending on the pivotal position of said arm and said connecting member;

said rotary actuator including a housing connected to said arm and having a cylindrical bore, a piston reciprocably disposed in said bore, at least two sets of cooperable helical splines including internal and external splines formed on said piston, a shaft mounted on said housing for rotation in response to movement of said piston in said bore, said shaft including splines cooperable with said internal splines on said piston, further splines in said housing cooperably engaged with said external splines on said piston, and means interconnecting said shaft and said feed bar so that in response to actuation of said piston to rotate said shaft said feed bar may be rotatably positioned about said axis of rotation.

2. The invention set forth in claim 1 together with:

first bearing means disposed in said housing and supporting said shaft intermediate the ends thereof, and second bearing means disposed in a bore in said piston for axial and rotatable movement relative to said piston, said second bearing means being retained on one end of said shaft for supporting said one end in said bore.

3. The invention set forth in claim 2 wherein:

said first bearing means comprises first and second tapered roller bearing assemblies mounted on said shaft in back to back relationship and separated by a shoulder formed on said shaft.

4. The invention set forth in claim 2 wherein:

said piston includes a head portion and an elongated piston rod extending from one side of said head portion and said piston includes third bearing means retained on said piston rod adjacent the end of said rod opposite said head portion for supporting said piston.

5. The invention set forth in claim 4 wherein:

said second and third bearing means comprise sleeve-like bushings removably retained on said shaft and said piston rod, respectively.

6. A rock drill positioning mechanism for positioning a drill feed bar or the like in combination with an elongated movable boom, said positioning mechanism being characterized by:

a connecting member pivotally mounted on the distal end of said boom;

a mounting arm pivotally connected to said connecting member;

actuator means interconnected between said connecting member and said arm for pivoting said arm with respect to said connecting member; and, a rotary actuator mounted on said arm and adapted to support said feed bar for rotating said feed bar about an axis of rotation, said rotary actuator including a housing connected to said arm and having a cylindrical bore, a piston reciprocably disposed in said bore, at least two sets of cooperable helical splines including internal and external splines formed on said piston, a shaft mounted on said housing for rotation in response to movement of said piston in said bore, said shaft including splines cooperable with said internal splines on said piston, further splines in said housing cooperably engaged with said external splines on said piston, and means interconnecting said shaft and said feed bar so that in response to actuation of said piston to rotate said shaft said feed bar may be rotatably positioned about said axis of rotation.

7. A rock drill positioning mechanism for positioning a drill feed bar or the like in combination with an elongated movable boom, said postioning mechanism being characterized by:

a connecting member pivotally mounted on the distal end of said boom;

a mounting arm pivotally connected to said connecting member;

actuator means interconnected between said connecting member and said arm for pivoting said arm with respect to said connecting member;

a rotary actuator mounted on said arm and adapted to support said feed bar for rotating said feed bar about an axis of rotation which may be substantially coincident with the longitudinal axis of said boom depending on the pivotal position of said arm and said connecting member;

a support structure for said boom;

a rotary swing actuator including a housing mounted on said support structure and supporting the end of said boom opposite said distal end, said swing actuator being operable to move said boom about a substantially vertical pivot axis;

said swing actuator including a bore in said housing, a shaft mounted in said bore for rotation with respect to said housing, a piston disposed for axial movement in said bore and forming opposed fluid chambers in said bore, said piston including a hollow rod portion, a first set of interfitting helical splines formed on said rod portion and said shaft, a second set of interfitting helical splines formed on said rod portion and on means fixed to said housing, the helix of said second set of splines being opposite to that to said first set, said swing actuator being operable in response to the axial movement of said piston for effecting rotation of said boom about said vertical pivot axis.

8. The invention set forth in claim 7 wherein:

said support structure includes a pair of spaced apart brackets, said shaft having opposite end portions extending from said housing and secured nonrotatably to said brackets and said housing includes means for mounting said boom on said housing for movement about a horizontal pivot axis, said housing being operable to rotate said boom about said vertical pivot axis in response to axial movement of said piston.

9. A rock drill positioning mechanism adapted to be mounted on the distal end of a drill boom and being characterized by:

a mounting arm mounted on the distal end of said boom for pivotal movement relative thereto; and, a rotary actuator mounted on said arm, said rotary actuator including an inner housing member connected to said arm and having a cylindrical bore therein, a piston disposed for axial movement in said bore, said piston including an elongated hollow rod portion having internal and external splines formed thereon, a shaft rotatably mounted in said inner housing and including elongated helical splines cooperable with said internal splines on said rod portion, further splines fixed to said housing and cooperable with said external splines on said rod portion, and means connected to said shaft and supported on said rotary actuator for rotatably positioning a rock drill feed bar about the axis of rotation of said shaft in response to movement of said piston.

10. The invention set forth in claim 9 wherein:

said internal splines on said rod portion are formed in a bore in said rod portion, said shaft having one end thereof disposed in said bore, and said shaft includes bearing means disposed on said one end and slidably engaged with said rod portion.

11. The invention set forth in claim 10 wherein:

said external splines on said rod portion are elongated helical splines cooperable with said splines fixed to said inner housing.

12. The invention set forth in claim 11 wherein:

said piston includes bearing means disposed on one end of said rod portion for supporting said one end, said bearing means comprising a sleevelike bushing retained on said one end.

13. The invention set forth in claim 9 wherein:

said means connected to said shaft comprises an outer housing disposed around said inner housing and rotatable relative thereto.

14. A rock drill positioning mechanism for positioning a drill feed bar or the like in combination with an elongated movable boom, said positioning mechanism being characterized by:

a connecting member pivotally mounted on the distal end of said boom;

a mounting arm pivotally connected to said connecting member;

actuator means interconnected between said connecting member and said arm for pivoting said arm with respect to said connecting member;

a rotary actuator mounted on said arm and adapted to support said feed bar for rotating said feed bar about an axis of rotation of said rotary actuator; and means for mounting said feed bar on said rotary actuator in a plurality of positions with respect to said rotary actuator about an axis which is substantially perpendicular to said axis of rotation of said rotary actuator, said means including a flange on said rotary actuator, a bracket adapted to support said feed bar, and means including a trunnion for locating said bracket on said flange and for retaining said bracket on said rotary actuator when said feed bar is moved from one position to another with respect to said rotary actuator.

15. In combination:

an elongated boom adapted to be pivoted about horizontal and vertical axes;

a support structure for said boom;

a rotary swing actuator mounted on said support structure and supporting one end of said boom;

said swing actuator including a housing, a bore in said housing, a shaft mounted in said bore for rotation with respect to said housing, a piston disposed for axial movement in said bore and forming opposed fluid chambers in said bore, said piston including a hollow rod portion, a first set of interfitting helical splines being formed on said rod portion and said shaft, a second set of interfitting helical splines formed on said rod portion and on means fixed to said housing, the helix of said second set of splines being opposite to the helix of said first set, said actuator being operable in response to axial movement of said piston to effect rotation of said boom about a substantially vertical pivot axis.

16. The invention set forth in claim 15 wherein:

said support structure includes a pair of spaced apart brackets, said shaft having opposite end portions extending from said housing and secured nonrotatably to said brackets and said housing includes means for mounting said boom on said housing for movement about a horizontal pivot axis, said housing being operable to rotate said boom about said vertical pivot axis in response to axial movement of said piston.

17. The invention set forth in claim 16 wherein:

said housing includes a clevis formed on its exterior and providing a pivotal mounting connection for said one end of said boom, and said boom includes actuator means interconnected between said boom and said housing for moving said boom about a horizontal pivot axis formed by said clevis.

* * * * *